US009829213B2

(12) United States Patent
Cook et al.

(10) Patent No.: US 9,829,213 B2
(45) Date of Patent: Nov. 28, 2017

(54) HEATER WITH TELESCOPING TOWER

(71) Applicant: Total Energy Resources, Inc., Sand Springs, OK (US)

(72) Inventors: Scott S. Cook, Broken Arrow, OK (US); Jose M. Pereira, Jenks, OK (US); Jeff K. Pruitt, Broken Arrow, OK (US)

(73) Assignee: OIL, GAS AND INDUSTRIAL PROCESS EQUIPMENT, Sand Springs, OK (US)

( * ) Notice: Subject to any disclaimer, the term of this patent is extended or adjusted under 35 U.S.C. 154(b) by 614 days.

(21) Appl. No.: 14/320,513

(22) Filed: Jun. 30, 2014

(65) Prior Publication Data

US 2015/0377510 A1 Dec. 31, 2015

(51) Int. Cl.

| | |
|---|---|
| ***F24H 1/06*** | (2006.01) |
| ***F24H 1/08*** | (2006.01) |
| ***F24H 1/18*** | (2006.01) |
| ***F24H 1/10*** | (2006.01) |
| ***F28D 21/00*** | (2006.01) |
| *F28D 1/06* | (2006.01) |

(52) U.S. Cl.

CPC ..... *F24H 1/06* (2013.01); *F24H 1/08* (2013.01); *F24H 1/107* (2013.01); *F24H 1/186* (2013.01); *F28D 21/0003* (2013.01); *F28D 1/06* (2013.01)

(58) Field of Classification Search

CPC ..... F24H 1/06; F24H 1/08; F24H 1/10; F24H 1/07; F24H 1/186; F28D 21/0003; F28D 1/06

See application file for complete search history.

(56) References Cited

U.S. PATENT DOCUMENTS

| | | | | |
|---|---|---|---|---|
| 884,223 A * | 4/1908 | Shipley | F24H 1/107 122/367.1 |
| 1,140,896 A | 5/1913 | Forsyth | |
| 2,904,209 A * | 9/1959 | Murdock, Sr. | F17B 1/00 220/8 |
| 2,990,970 A * | 7/1961 | Murdock, Sr. | F17B 1/00 220/23.2 |
| 3,826,240 A * | 7/1974 | Miyahara | F24H 1/107 126/355.1 |
| 4,077,568 A * | 3/1978 | May | F24H 9/02 122/494 |

(Continued)

FOREIGN PATENT DOCUMENTS

| | | |
|---|---|---|
| CN | 101545687 | 9/2009 |

OTHER PUBLICATIONS

Residential Energy Saver Gas Power Direct Vent Water Heater, brochure, 2004, Bradford White.

*Primary Examiner* — Christopher Harmon

(74) *Attorney, Agent, or Firm* — Cherskov Flaynik & Gurda, LLC

(57) ABSTRACT

The present invention provides a large-scale water heater with a telescoping tower having a tower with a storage area proximal to the bottom of the tower; a portion of the tower that telescopes vertically that is pre-filled with a packing media; a nozzle designed to distribute a fluid that is located above the packing media; a firing chamber with a proximal end in fluid communication with the tower; and a burner in fluid communication with the distal end of the firing chamber for combusting fuels.

17 Claims, 5 Drawing Sheets

(56) References Cited

U.S. PATENT DOCUMENTS

| | | | | | |
|---|---|---|---|---|---|
| 4,275,708 | A * | 6/1981 | Wood | B01J 19/30 | 126/355.1 |
| 4,301,772 | A | 11/1981 | Eising | | |
| 4,753,220 | A * | 6/1988 | Lutzen | F24H 1/107 | 122/20 A |
| 4,765,280 | A * | 8/1988 | Kobayashi | F24H 1/107 | 122/14.3 |
| 5,168,861 | A * | 12/1992 | Lutzen | F24H 1/107 | 126/355.1 |
| 6,557,501 | B2 | 5/2003 | Hughes | | |
| 6,776,153 | B1 * | 8/2004 | Walker | F24H 1/107 | 126/350.1 |
| 7,000,572 | B1 | 2/2006 | Schimmeyer | | |
| 8,047,164 | B2 | 11/2011 | Hughes | | |
| 8,662,023 | B2 | 3/2014 | Yoo | | |
| 2013/0145996 | A1 * | 6/2013 | Cooper | F22D 5/00 | 122/31.2 |
| 2015/0218024 | A1 * | 8/2015 | Haase | C02F 3/2846 | 210/188 |

* cited by examiner

HEATER WITH TELESCOPING TOWER

BACKGROUND OF THE INVENTION

1. Field of the Invention

This invention is directed to a large water heater with a telescoping tower that increases the ease of transporting the water heater.

2. Background of the Invention

Hydraulic Fracturing, commonly known as "fracking," has emerged as a useful process for extracting liquid and gaseous fossil fuels from fields that were previously believed to be exhausted or inaccessible. The process of fracking involves pumping high pressure fracturing fluid into a shale field, spent oil or gas well, or other fossil fuel formation to produce fractures in the rock formation. The liquid contains a proppant, such as grains of sand, ceramics, or coated ceramics, which stabilize the fractures and hold them open. The fractures allow a flow path for the trapped oil or natural gas to flow into a well. The newly released fuel is then extracted for refining or consumption.

Fracking requires a constant supply of heated water. Hot water is necessary in order for the fracking chemical additives to work properly. Additionally, using heated water reduces the viscosity of the fracking fluids as well as the production fluids, which enhances the fuel recovery. Most fracking sites are located in isolated, undeveloped areas. Thus, the fracking sites do not have facilities to provide a steady supply of heated water. Consequently, water heaters must be brought to the fracking site.

Transportation of large water heaters poses a unique set of problems. First, the transportation means must be capable of traveling to isolated, undeveloped areas. Accordingly, transportation typically occurs via semi-trailer trucks. Since these trucks travel over road, the cargo must be capable of passing under bridges, tunnels, power lines, overhead signs, and overpasses. This limitation creates a second problem: the size of the water heater. If the water heater is extremely large, then it will not fit under bridges, tunnels, power lines, overhead signs, and overpasses, and it must be shipped piecemeal to and assembled at the fracking site. Further, movement of the water heater around the job site or to another job site requires disassembly. If the water heater is small enough to fit under bridges and overpasses, then it may not be large enough to provide a sufficient supply of hot water for the fracking process. In this case, additional water heaters must be used provided, which increases the cost of the operation and decreases the available space on the fracking site.

Thus, a need exists in the art for a large water heater that is also transportable using standard heavy equipment while also allowing for travel on roads and highways with bridges, tunnels, and overpasses.

SUMMARY OF THE INVENTION

An object of the present invention is to improve upon prior art water heaters that are used in fracking operations.

Another object of the present invention is to provide a large-scale, portable water heater. A feature of the present invention is the telescoping tower. An advantage of the present invention is that the water heater can be transported under bridges, trees, power lines, and other road obstacles when the tower is in the nested position.

Another object of the present invention is to provide a water heater that can easily be moved from place to place. A feature of the present invention is that the stack is mechanically or electrically raised and lowered via hydraulics, jack threads, worm gears, and linear electric motors, among others. An advantage of the present invention is that the tower can quickly be raised or lowered on site without difficult deconstruction or additional machinery.

The present invention provides a heater with a telescoping tower, comprising: a tower having a storage area proximal to the bottom of the tower; a portion of the tower that telescopes vertically, wherein the portion is pre-filled with a packing media; a nozzle designed to distribute a fluid, wherein the nozzle is located above the packing media; a firing chamber with a proximal end and a distal end, wherein the proximal end is in fluid communication with said tower; and a burner for combusting fuels, wherein the burner is in fluid communication with the distal end of the firing chamber.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element recited in the singular and preceded with the word "a" or "an" should be understood as not excluding plural of said elements, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
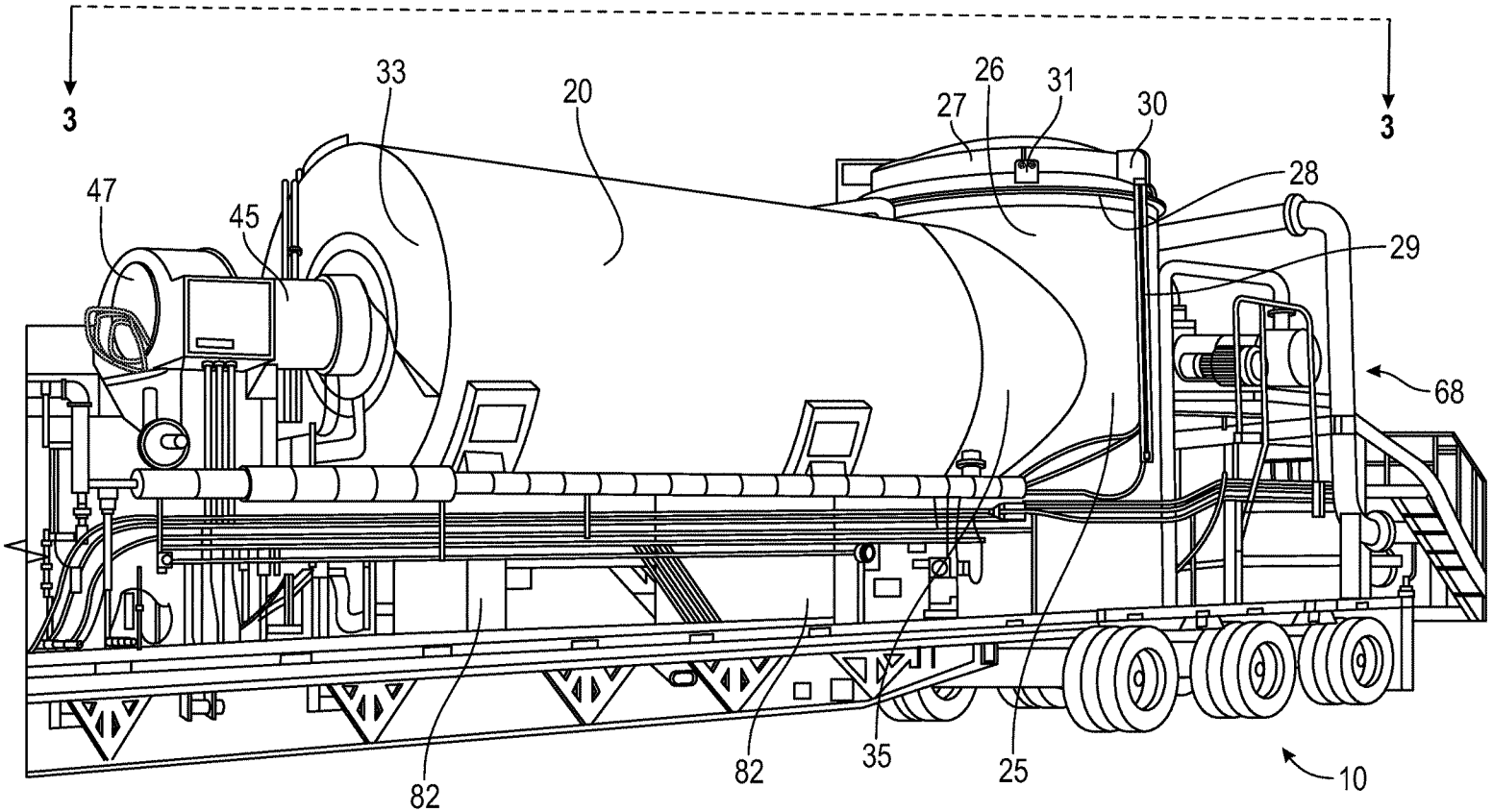
FIG. 1 is a perspective view of the present invention with the tower lowered.

The present invention is directed to a water heater 10 with a telescoping tower 25. FIG. 1 depicts the water heater 10 with the tower 25 in a first, or lowered, configuration. As depicted in the embodiment of FIG. 1, the water heater 10 is mounted on a flatbed semitrailer. However, the water heater 10 is installed on a standalone vehicle or mounted on another substrate, in other embodiments. When lowered, the water heater 10 can be moved around a job-site or moved between job-sites. During operation, the tower 25 is extended to a second raised configuration shown in FIG. 2.

The water heater 10 is generally comprised of a horizontal firing chamber 20 in fluid communication with a vertical tower 25. Generally, hot gases from the firing chamber rise through the vertical tower and transfer heat energy to water that falls from the top of the vertical tower.

Water Heater Design

Figure 2:
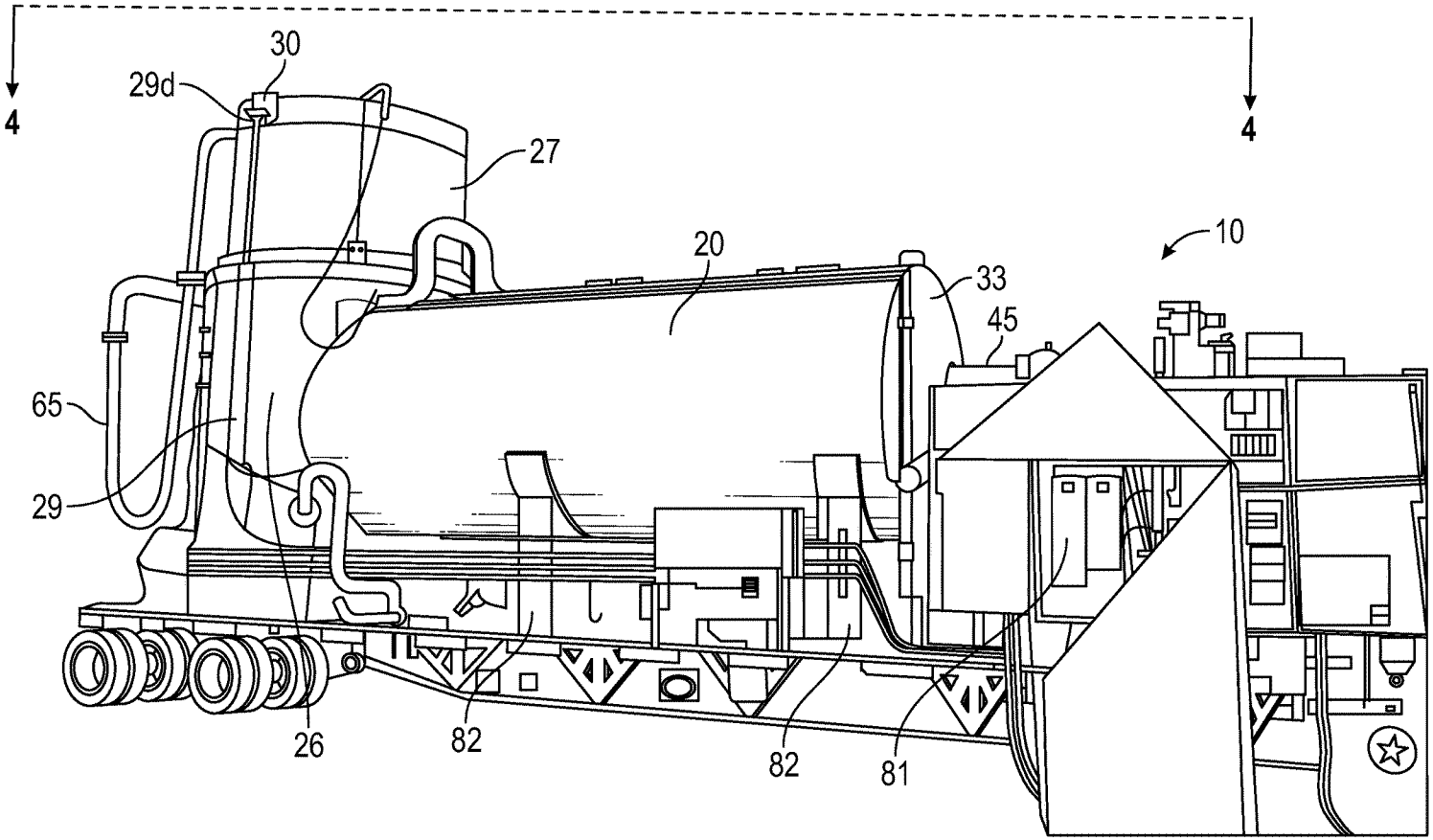
FIG. 2 is a perspective view of the present invention with the tower raised.

As shown in FIGS. 1 and 2, the vertical tower 25 is comprised of a first housing portion 26 and a second telescoping portion 27. The second telescoping portion 27 is substantially nested inside the housing portion 26 when the tower is in the lowered position. A rim 28 is formed around the top of the housing portion 26. The rim 28 acts as a stop that limits the vertical extension of the tower. A plurality of arms 29 is mounted to housing portion 26. The depending end 29*d* of each arm 29 is in mechanical communication with a corresponding attachment point 30 on the telescoping portion 27, such that, when the arms 29 are actuated, the telescoping portion 27 is raised from within the housing portion 26. In a preferred embodiment, the arms 29 are hydraulically actuated; however, the arms 29 can be actuated in other ways, such as jack screws, worm gears, pneumatic action, and linear electric motors, and combinations thereof.

The telescoping portion 27 optionally features alignment means 31. As can be seen in FIG. 2, the alignment means 31 are lands and grooves, wherein the raised lands are on the telescoping portion 26 and the grooves are mounted to the rim 28.

The firing chamber 20 has a first end 33 and a second end 35. At the first end 33, a fuel inlet line 40 (shown schematically in FIG. 5) supplies fuel to a burner 45. A blower 47 is mounted near the burner 45, and the blower 47 draws in ambient air to mix with the fuel. In one embodiment, the blower 47 is supplied with pressurized air from an air compressor 49 (shown schematically in FIG. 5). The blower 47 and burner 45 may be distinct components, or the blower 47 and burner 45 can be part of the same integrated component. If the blower 47 and burner 45 are separate components, preferably they are made by the same manufacturer. The burner 45 ignites the fuel/air mixture, which causes a combustion reaction. The blower 47 directs the resulting flame into the firing chamber 20. Combustion of fossil fuels is an exothermic reaction, and thus, the reaction products, or exhaust gases, are hot. Flame temperatures in the firing chamber 20 can reach up to 2,500° F. for natural gas and up to 3,500° F. for propane. The exhaust gases enter the vertical tower at a temperature of approximately 2,200° F. When carbon-based fuels are used, the exhaust gases primarily consist of carbon dioxide, water vapor, and nitrogen from the air.

Figure 3:
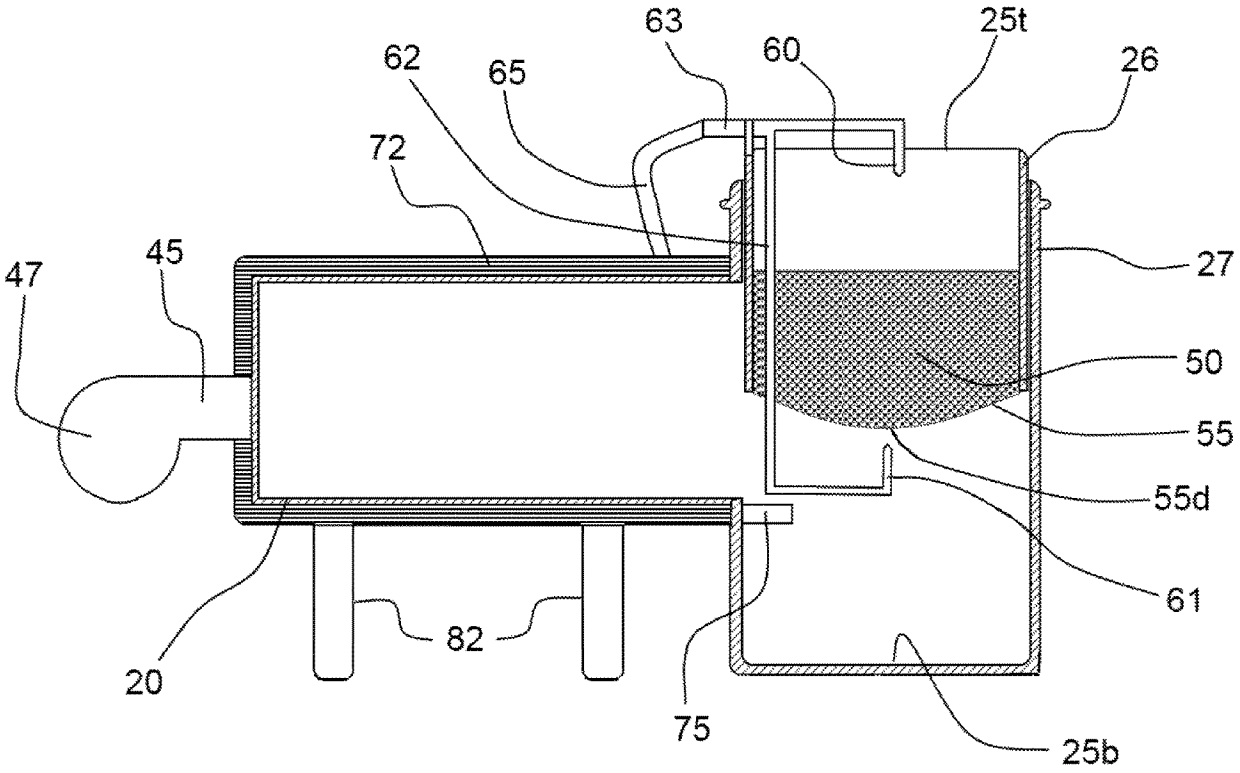
FIG. 3 is a sectional view of the present invention taken along line 3-3 in FIG. 1.

The firing chamber 20 is in fluid communication with the vertical tower 25. Because of pressure from the blower, the exhaust gases are forced into the tower 25. FIG. 3 shows that, within the tower 25, the hot gases come in contact with packing media 50. In the depicted embodiment, the packing media 50 is supported in the tower 25 by a basket 55.

The packing media 50 has several important characteristics. First, the exhaust gases must be able to flow through the packing media 50 so that the exhaust gases can be vented. Otherwise, the gases will back up into the firing chamber 20 and choke the combustion reaction. Therefore, the shape and size of the packing media 50 must allow the gases to continue their upward flow through the tower 25. Second, the packing media 50 should provide a maximum amount of surface area so that heat can be efficiently exchanged from the exhaust gases to the falling fluid. Lastly, the packing media should be resistant to both wet and dry corrosion, especially from oxygen. The water tower components must be able to perform in an environment of high temperature gases and liquids, and materials with high corrosion resistance will prolong the life of the water heater.

Packing media come in two varieties: random and structured. Random packing is comprised of a plurality of individual constituents. The constituents are shaped such as to provided dense packing while also providing pores or gaps for the exhaust gases to flow upwardly through and the water downwardly through. Examples of random packing media include Berl saddles, Intalox saddles, Raschig rings, Pall rings, Nutter rings, and combinations thereof. The random packing media are typically made from ceramic, metal, or plastic, and they provide a large surface area within the tower for interaction between the exhaust gases and the water.

The second type of packing media is structured. Structured packing utilizes thin corrugated metal plates or porous metal gauzes, foams, or meshes. Structured packing media provide a high surface area with low resistance to gas flow and an increased ability to spread liquid throughout the packing media.

While not a packing media, another heat exchange medium consists of a series of horizontal trays that alternatingly extend from the sides of the telescoping portion of the tower. By extending in an alternating fashion, the trays create a zigzag pattern over which the water flows. The trays feature pores to allow gas to flow upwardly. Thus, as the water snakes its way from the top of the tower towards the bottom, the hot exhaust gases flow upwardly through the trays, heating the water.

Any of the aforementioned packing media may be used with the present invention. In an embodiment of the present invention, the packing media 50 is a plurality of stainless steel Nutter rings. The stainless steel rings provide good corrosion resistance at the operating temperatures and are a relatively inexpensive option for this application.

If the packing media 50 is a metal, then preferably the basket 55 is made of the same material as the packing media. Doing so will help avoid any potential galvanic corrosion. Nevertheless, the basket 55 is made of a different material in some embodiments. If the packing media 50 is made from a ceramic or plastic material, then the basket 55 can be made of any of a variety of high-temperature, corrosion-resistant materials. Like the packing media, the basket should also allow the exhaust gases to flow upwardly through the tower. In one embodiment, the basket 55 is made from expanded stainless steel sheet. The basket 55 as shown has a depression 55*d*, but the basket 55 is flat in other embodiments.

As the hot exhaust gases flow through the basket 55 and packing media 50, heat from the gases will be transferred to water traveling downwardly through the packing media 50. The cooled gas continues to rise and is vented through the top 25*t* of the tower 25. The temperature of the exhaust gases exiting the tower is dependent on the inlet water temperature. Nonetheless, the temperature is generally greatly lowered given the transfer of heat energy from the exhaust as it traverses the tower. In one embodiment, the final exhaust gases are vented at a temperature of approximately 100° F.

Figure 4:
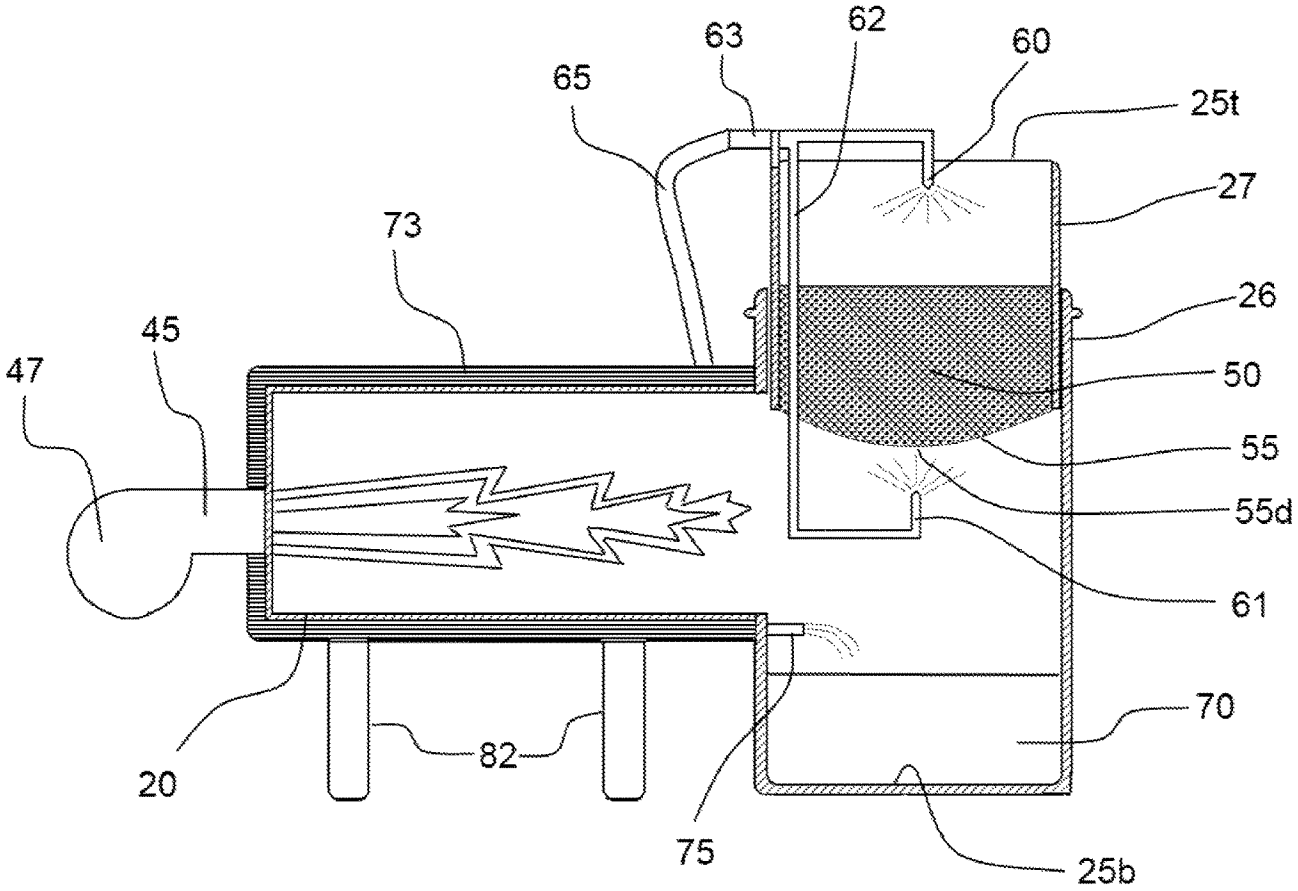
FIG. 4 is a sectional view of the present invention taken along line 4-4 in FIG. 2.
Figure 5:
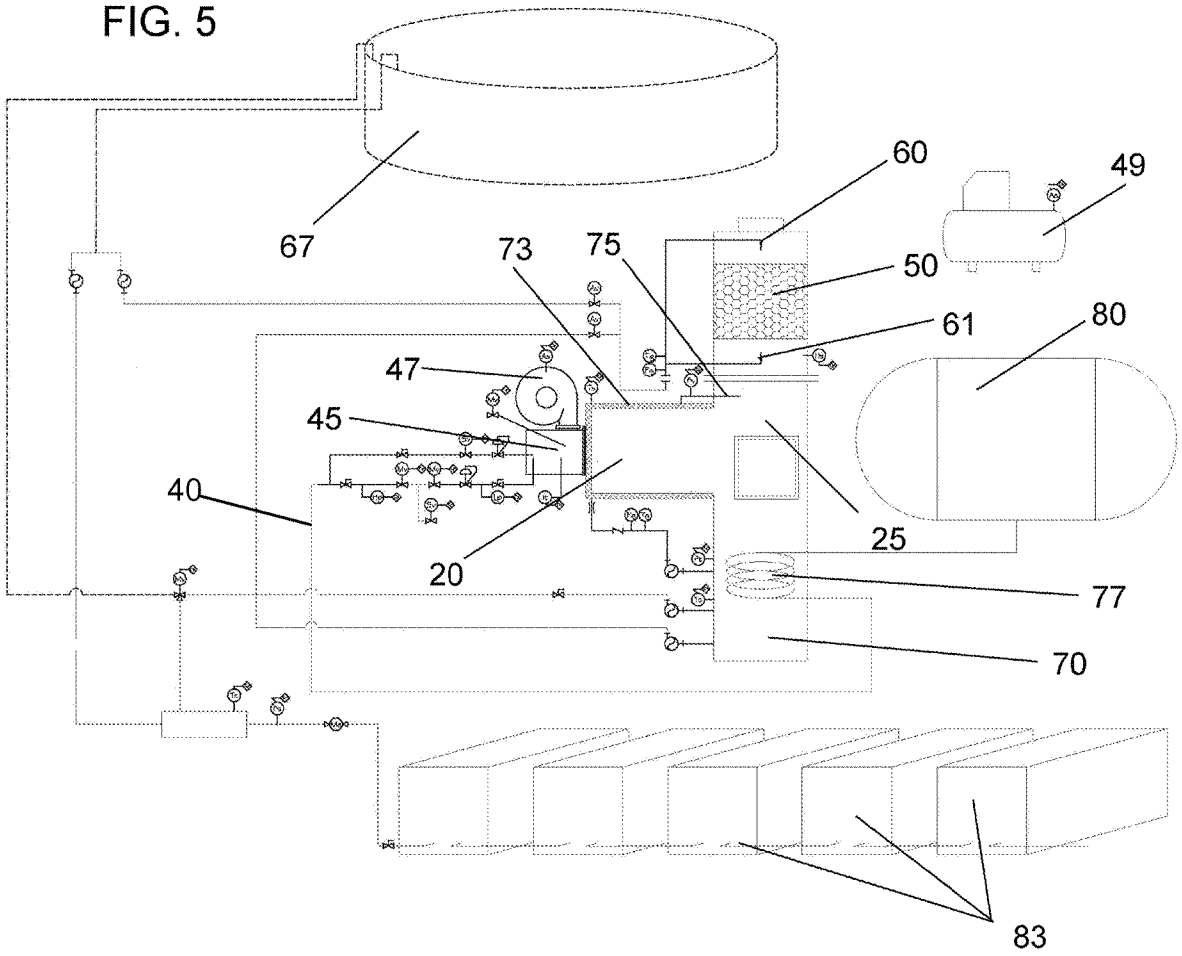
FIG. 5 is a schematic view of the present invention as it is applied to a fracking operation.

As shown in FIG. 4, proximal to the top 25*t* of the tower 25 is a fluid nozzle 60. The fluid nozzle 60 is supplied with a fluid via inlet line 65. As can be seen in FIG. 5, the fluid inlet line 65 pulls fluid from a reservoir 67 onsite, which may be a well, lake, river, storage tank, or other fluid source. As shown in FIG. 1, the semitrailer features a pumping means 68 to draw water from the reservoir 67; however, the pumping means 68 need not be provided with the present invention if one is already on site. Since the top of the tower extends vertically when telescoped, the fluid inlet line 65 is preferably made from a flexible conduit, such as hose, so that it can rise with the telescoping portion 27 of the tower 25. Referring again to FIG. 4, the fluid is pumped through the inlet line 65 and out the nozzle 60. In some embodiments, a second nozzle 61 is provided below the basket 55. The second nozzle 61 sprays fluid upwardly onto the basket and is designed to cool the basket 55 and adjacent packing media 50. Preferably, the nozzle 60 or nozzles 60, 61 spray the fluid in a conical fashion as opposed to simply spraying a jet of fluid onto the packing media 50 and basket 55. In this way, the fluid is dispersed over more packing media 50. The second nozzle 61 is connected to the first nozzle 60 via a vertical conduit 62 that runs from a common manifold 63 downwardly through the packing media 50.

The fluid from the nozzle 60 percolates through the packing media 50, absorbing the heat from the hot exhaust gases rising through the packing media 50. The packing media 50 provides a tortious path for the water to flow and increases the residence time for which the water is in contact with the hot exhaust gases. The fluid flows through the basket 55 and continues to fall into a storage area 70 at the bottom 25*b* of the tower 25. The fluid from the second nozzle 61 also absorbs heat from the basket 55 and packing media 50. The fluid is heated and falls into the storage area 70 below similar to the fluid from the upper nozzle 60. When the fluid to be heated is water, the water typically attains a temperature of approximately 150° F. when finally stored in the storage area 70. However, the heater is capable of providing water at temperatures exceeding 180° F.

In an embodiment of the present invention, the firing chamber 20 is water cooled. As shown in FIGS. 3 and 4, the firing chamber 20 is surrounded by a water jacket 73. The water jacket 73 serves two functions. First, the water jacket 73 cools the firing chamber 20. Temperatures in the firing chamber 20 may reach as high as 3,500° F. Having a jacket of water around the firing chamber prevents the interior of the chamber from experiencing extreme elevated temperatures and reduces the temperature of the exposed material on the outside of the heater. Second, the water jacket improves the heat capture efficiency. The water in the water jacket 73 is heated as it absorbs heat energy from the firing chamber. This heated water is then added to the hot water storage area 70. In FIG. 4, the water jacket 73 has a discharge spout 75 that provides hot water to the storage area 70. Without the water jacket 73, more of the heat energy produced in the combustion reaction would be lost to the ambient atmosphere around the water heater.

In another embodiment of the present invention, which can be seen in FIG. 5, a vaporizer coil 77 resides in the hot water storage area 70. The vaporizer coil 77 is in fluid communication with a fuel reservoir 80 on one end and in fluid communication with a fuel consumer on the other end. In a preferred embodiment, the fuel consumer is the burner 45; however, the fuel could be used for another fuel consuming process operating near the water heater location. The purpose of the vaporizer coil 77 is to heat the fuel from the fuel reservoir 80 to improve combustion efficiency in the fuel consumer. The vaporized fuel mixes more completely with air, producing a more optimal fuel to air ratio and allowing for a more complete burn. In a preferred embodiment, the fuel is liquefied propane gas.

Transportation and Operation

Because fracking fields are often in isolated, undeveloped areas, equipment must be brought to the fracking operation. Many forms of transportation are unsuitable or uneconomical. For example, equipment cannot reliably be shipped by train because the fracking site may not be conveniently located near train tracks. Shipping equipment to the fracking site over air is not economical because of the high cost of helicopter operation and fuel. Therefore, the most reliable and economical way of sending equipment to a fracking site is to ship it over road via semitrailer trucks.

Roads, especially interstate highways, frequently contain overhead signs, bridges, and overpasses. The American Association of State Highway and Transportation Officials sets minimum standards for the heights of these structures, which is at most sixteen feet. Many overpasses are higher than this height, often as a result of the terrain surrounding the interstate. However, few overpasses are as high as is needed to drive a large water heater under.

In the embodiment depicted in FIG. 1, the water tower is approximately 42 feet long and has an unextended height of 11.5 feet from the trailer. The firing chamber has an outside diameter of approximately 84 inches and a midline height of 75 inches from the trailer bed. The firing chamber is typically supported on a plurality of legs 82. The total height during transportation (i.e., including the height of the trailer) is approximately 15 feet, which is low enough to fit under most highway overpasses, tunnels, and overhead signs on the interstate system, especially those outside of urban areas where the present invention is most likely to be used.

During transportation of the water heater, the telescoping portion 27 of the tower 25 is lowered such that it is nested within the housing portion 26. In the embodiment as shown in FIGS. 1 and 2, this reduces the overall height of the water heater by five feet. In the lowered position, the water heater is transported from factory or storage to the job site. The tower is pre-packed with packing media to facilitate ease of setup and operation.

When the water heater is ready for use, the user activates the arms 29 on the vertical tower 25. FIG. 2 shows a typical control panel 81 for operating the water heater 10. Operation of the water heater 10 may also require the use of an on-site electric generator (not shown). In the depicted embodiments, the arms 29 are hydraulic and are, thus, actuated via a hydraulic pump, which is controlled by the user. The hydraulic pump does not necessarily need to be a component of the water heating system; instead, it can be another piece of on-site equipment or it can be shipped on the same semitrailer as the water heater. In one embodiment of the present invention, two hydraulic arms 29, each having a diameter of 1 inch, are used to raise the telescoping portion 27 of the tower 25. In this embodiment, the telescoping portion 27 weighs approximately 4,500 pounds, and so, each arm 29 needs to supply approximately 2,500 psi of pressure. In one embodiment, the hydraulic system uses pressure as low as 600 psi. In this lower-pressure embodiment, the surface area of the hydraulic cylinder bore is adjusted to achieve the same lifting strength as a high pressure embodiment. In further embodiments, more than two hydraulic arms are employed.

Upon raising the tower 25 to full height, the burner 45 and blower 47 begin mixing and combusting fuel. The flame produced during fuel combustion is contained entirely in the firing chamber 20. In prior art water heaters, the flame is exposed to the downwardly flowing water. Such an arrangement can cause the flame to become quenched. It also can cause incomplete combustion of the fuel by upsetting the proper air to fuel ratio. By containing the flame in the firing chamber 20, as in the present invention, these problems are avoided.

Water is pumped through the nozzles 60, 61 into the tower 25. The water is heated and stored in the storage area 70. The water is pumped from the storage area 70 to larger storage tanks 83 called "frac tanks" There, the water is held until it is pumped into a fracking well.

The disclosed embodiment advantageously provides a large and mobile hot water heater that has particular applicability to fracking operations. The disclosed size is capable of operating at 35-40 million BTU/h, producing up to 667 gallons of water at 152° F. per minute. Use of this size of water heater at a fracking site is possible because the telescoping tower allows for over-the-road transportation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A heater with a telescoping tower, comprising:

a) a tower having a storage area proximal to the bottom of the tower;

b) a portion of the tower that telescopes vertically, wherein the telescoping portion is pre-filled with an amount of packing media;

c) a nozzle designed to distribute a fluid, wherein the nozzle is located above the packing media;

d) a firing chamber with a proximal end and a distal end, wherein the proximal end is in fluid communication with said tower; and e) a burner for combusting fuels, wherein the burner is in fluid communication with the distal end of the firing chamber, wherein a means for deploying the telescoping tower is two arms that are equidistantly spaced around the perimeter of the telescoping tower.

2. The heater as recited in claim 1, wherein the packing media is selected from the group consisting of Berl saddles, Intalox saddles, Raschig rings, Pall rings, Nutter rings, and combinations thereof.

3. The heater as recited in claim 2, wherein the packing media is a plurality of 1.5 inch Nutter rings.

4. The heater as recited in claim 1, wherein the telescoping portion of the tower extends the height of the tower by approximately 5 feet when the tower is fully telescoped.

5. The heater as recited in claim 1, wherein the heater is configured to be mobile.

6. The heater as recited in claim 5, wherein the heater is mounted on a semi-trailer.

7. The heater as recited in claim 1, wherein the amount of packing media defines a direct contact heat zone within the telescoping portion that extends at least 3 feet.

8. The heater as recited in claim 1, wherein the tower is circular with a diameter of approximately 7.5 feet.

9. The heater as recited in claim 1, wherein the means for deploying the telescoping stack is selected from the group consisting of pneumatic arms, worm gears, jack threads, linear electric motors, and combinations thereof.

10. A heater with a telescoping tower, comprising:

a tower having a storage area proximal to the bottom of the tower;

a portion of the tower that telescopes vertically, wherein the telescoping portion is pre-filled with an amount of packing media;

a nozzle designed to distribute a fluid, wherein the nozzle is located above the packing media;

a firing chamber with a proximal end and a distal end, wherein the proximal end is in fluid communication with said tower; and a burner for combusting fuels, wherein the burner is in fluid communication with the distal end of the firing chamber further comprising a second nozzle below the packing media, wherein the second nozzle is aimed upwardly to dispense water on the bottom of the packing media.

11. The heater as recited in claim 10, wherein the firing chamber is at least partially surrounded by a water jacket.

12. The heater as recited in claim 11, wherein the water jacket has a water discharge spout at one end proximal to the tower.

13. The heater as recited in claim 10, wherein a fuel vaporizer is located in the storage area of the tower.

14. The heater as recited in claim 13, wherein the fuel vaporizer vaporizes fuel for the heater.

15. The heater as recited in claim 14, wherein the fuel is liquefied propane gas.

16. The heater as recited in claim 10, wherein firing chamber substantially contains the flame produced in the combustion reaction in the burner.

17. The heater as recited in claim 10, wherein the heater is capable of operating above 30 million BTU/h.

* * * * *